US005979602A

United States Patent [19]

Grout

[11] Patent Number: 5,979,602

[45] Date of Patent: Nov. 9, 1999

[54] PERSONAL MINI-HOIST

[76] Inventor: Melvin Grout, Box 711, Springfield, Ohio 45501

[21] Appl. No.: 09/079,119

[22] Filed: May 14, 1998

[51] Int. Cl.[6] ..... E04G 1/18

[52] U.S. Cl. ..... 182/142; 182/187; 182/188

[58] Field of Search ..... 182/141, 142, 182/143, 144, 145, 146, 147, 148, 149, 150, 187, 188, 132, 37, 119; 187/261

[56] References Cited

U.S. PATENT DOCUMENTS

| | | | |
|---|---|---|---|
| 2,433,859 | 1/1948 | McCormick | 182/142 |
| 3,630,315 | 12/1971 | Meyer | 182/142 |
| 3,661,226 | 5/1972 | Fisher | 182/142 |
| 4,347,913 | 9/1982 | Cromer, Jr. | 182/142 |
| 4,488,620 | 12/1984 | Gibson | 182/187 X |
| 4,552,248 | 11/1985 | Payne | 182/142 |
| 4,593,789 | 6/1986 | Treants | 182/142 |
| 4,602,698 | 7/1986 | Grant | 182/142 |
| 4,650,035 | 3/1987 | Eubanks | 182/101 |
| 4,811,803 | 3/1989 | Green | 182/142 X |
| 4,886,143 | 12/1989 | Dubroc | 182/142 |
| 4,921,070 | 5/1990 | Magill | 182/142 |
| 4,997,062 | 3/1991 | Pizzo | 182/132 |
| 5,009,284 | 4/1991 | Authement | 182/142 |
| 5,117,942 | 6/1992 | Tzavaras | 182/142 |
| 5,145,032 | 9/1992 | Puccinelli et al. | 182/142 |
| 5,423,398 | 6/1995 | Brown | 182/142 |
| 5,492,198 | 2/1996 | Williams | 182/187 X |
| 5,595,265 | 1/1997 | Lebrocquy | 187/261 |
| 5,617,932 | 4/1997 | Stuart | 182/187 |
| 5,682,961 | 11/1997 | Sotomayor et al. | 182/142 |

*Primary Examiner*—David M. Purol
*Assistant Examiner*—Bruce A. Lev
*Attorney, Agent, or Firm*—John D. Gugliotta

[57] ABSTRACT

A hoist is provided that aids in construction and/or maintenance tasks at elevated heights. The hoist is equipped with a centrally located stabilizer through which a steel cable connected to an electrically operated winch is routed. The hoist is raised and lowered through the use of a control station located within reach of the seat.

10 Claims, 5 Drawing Sheets

PERSONAL MINI-HOIST

BACKGROUND OF THE INVENTION

1. Field of the Invention

The present invention relates generally to lift apparatuses and, more particularly, to an personal mini-hoist to aid in construction and maintenance procedures at elevated locations.

2. Description of the Related Art

Construction and maintenance operations at elevated heights have been a source of problems for mankind since the beginning of time. The most common tool used to deal with heights has been the ladder. The ladder is a portable tool, which is easily setup and utilized by the common user. However, the ladder also poses many problems of its own. These problems include difficulty in carrying items while climbing or descending the ladder, user comfort while on the ladder, difficulty in using electrically powered tools while on the ladder and most importantly safety. The safety of conventional ladders is easily compromised by improper setup, leaning too far to one side by the user, or by trying to use both hands to perform a task which leaves the user with no means to secure themselves to the ladder.

The previous art consists of many examples of devices designed to overcome the shortcomings of conventional ladders. Examples of these devices include U.S. Pat. No. 5,595,265, issued in the name of Lebrocquy, U.S. Pat. No. 5,117,942, issued in the name of Tzavaras, U.S. Pat. No. 4,602,698, issued in the name of Grant, U.S. Pat. No. 4,593,789, issued in the name of Treants, U.S. Pat. No. 4,552,248, issued in the name of Payne, and U.S. Pat. No. 4,347,913, issued in the name of Cromer, Jr., in which all disclose apparatuses primarily intended for tree climbing to aid in the purposes of hunting. While these apparatuses overcome many problems associated with using ladders to climb trees, they do not address the difficulty of trying to carry and use tools to perform maintenance and construction tasks at elevated heights.

Devices primarily intended to aid in construction are defined in U.S. Pat. No. 5,423,398 issued in the name of Brown, U.S. Pat. No. 5,145,032, issued in the name of Puccinelli et al, U.S. Pat. No. 4,997,062, issued in the name of Pizzo, and U.S. Pat. No. 4,921,070 issued in the name of Magill. These devices are associated with large scaffolding and scaffolding accessory items and are as such not intended for portable use by one person. Also these devices are not easily mobilized and are intended for long term construction processes such as bricklaying and the like.

U.S. Pat. No. 5,009,284, issued in the name of Authement, Sr., addresses the aforementioned problems, by the use of a chair like structure equipped with a winch. However, additional problems associated with a device constructed in accordance with this disclosure include the inability to stand off from the work surface, the inability to readily use electrically powered tools, large work or tool carrying containers, the lack of an integral safety harness, and the requirement to use hand power to raise or lower the device.

Finally, U.S. Pat. No. 4,650,035, issued in the name of Eubanks, discloses an elevatable work station for use by painters, carpenters, or the like when painting or repairing elevated building structures. While such a device is portable and easily set up and used by one person, it also has many of the disadvantages as listed with the Authement, Sr. disclosure listed above. These include the inability to readily use electrically powered tools, large work or tool carrying containers, the lack of an integral safety harness, and the requirement to use hand power to raise or lower the device.

A search of the prior art did not disclose any patents that read directly on the claims of the instant invention.

Consequently, a need has been felt for providing an apparatus and method which overcomes the problems cited above.

SUMMARY OF THE INVENTION

It is therefore an object of the present invention to provide an improved personal mini-hoist.

It is therefore another object of the present invention to provide an personal mini-hoist that is easily setup, utilized and removed by one individual.

It is therefore yet another object of the present invention to provide an personal mini-hoist that is powered by electricity to perform the raising and lowering duties of the present invention.

It is therefore another object of the present invention to provide an personal mini-hoist that is equipped with a pair of large storage compartments for the purposes of storing and transporting tools, material, food and the like.

It is therefore yet another object of the present invention to provide an personal mini-hoist that is equipped with integral safety devices such as a seat belt, chest protector, and safety line lanyards.

It is therefore another object of the present invention to provide an personal mini-hoist that is equipped with an integral stand-off rods that may be extended when the user is at the elevated work height to aid work procedures.

Briefly described according to the preferred embodiment of the present invention, an personal mini-hoist that aids in construction and/or maintenance tasks at elevated heights is disclosed. The personal mini-hoist is equipped with a centrally located stabilizer through which a steel cable connected to an electrically operated winch is routed. The personal mini-hoist is raised and lowered through the use of a control station located within reach of the seat. Also provided as safety and comfort features are a seat belt, chest protector, tie off lanyards, and stand off extension rods. Two large compartments on either side of the seat provide a means to carry and transport tools, equipment and other objects to the intended work site. An integral electrical outlet provides a means to connect portable electrical hand tools such as drills, without the use of an additional electrical extension cord.

It is a feature of the present invention to provide a device that can be easily produced using existing technology, materials and assembly techniques.

Another advantage of the present invention is that it is simple, and therefore, inexpensive to manufacture. This savings, if passed on to the consumer, may influence the public to utilize such a device. A simple design also increases product reliability and useful product lifetime.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

In order to describe the complete relationship of the invention, it is essential that some description be given to the manner and practice of functional utility and description of an personal mini-hoist.

The best mode for carrying out the invention is presented in terms of its preferred embodiment, herein depicted within the Figures.

1. Detailed Description of the Figures

Figure 1:
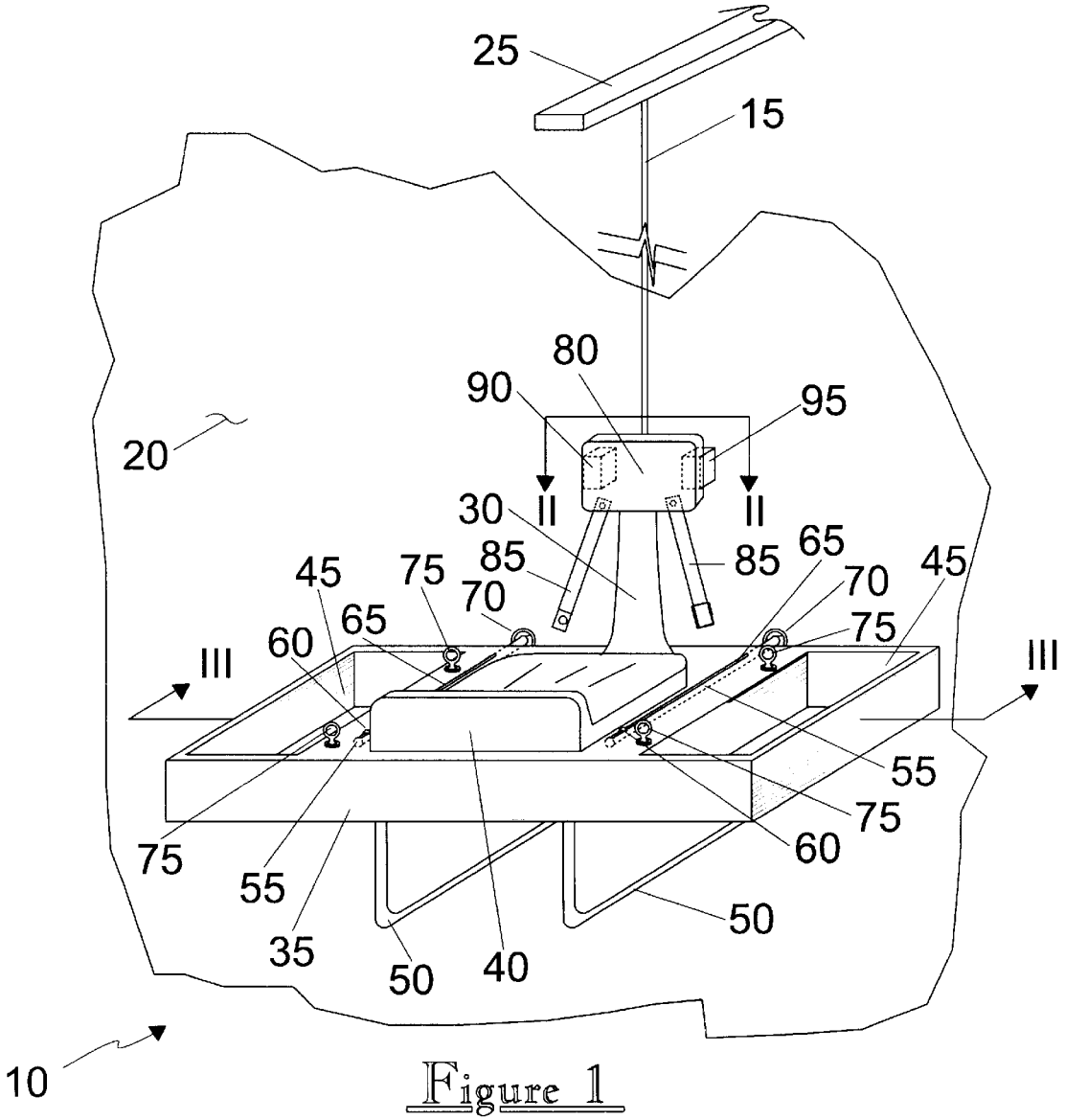
FIG. 1 is a perspective view of an personal mini-hoist shown according to a preferred embodiment of the present invention.

Referring now to FIG. 1, a perspective view of an personal mini-hoist 10 according to a preferred embodiment of the present invention is disclosed. The personal mini-hoist 10 is supported solely from a support cable 15 when it is in a utilized state as shown. The support cable 15 is envisioned to be manufactured from stainless steel or other such material possessing equal corrosion resistance and strength properties. The personal mini-hoist 10 is designed to work against a vertical work surface 20, such as a house, building or other such structure. The work that is carried out on the vertical work surface 20 can vary widely. It is anticipated that some of the work processes would include construction, repair, remodeling, maintenance and the like. The distance the personal mini-hoist 10 may perform work above grade is limited only by the length of the support cable 15, and as such is envisioned to vary from one foot to hundreds of feet. The support cable 15 is connected to a support member 25, such as a secured outrigger, a wall, a fixed stationary object or the like. The method of attachment of the support cable 15 to the support member 25 is envisioned to be that of a fixed, closed loop, but it can be easily seen by those familiar in the art that other means such as hooks, clamps or the like may also be utilized with equal effectiveness. The support cable 15 is routed through a stabilizer 30. The stabilizer 30 is designed to prevent the tipping of the personal mini-hoist 10 should a weight redistribution or outside forces such as wind, influence the horizontal stability of the personal mini-hoist 10. The stabilizer 30 is connected to a platform frame 35 on which a seat 40 and a pair of tool and material holding compartments 45 form the main components thereof. The seat 40 is of an adjustable nature and may be slid back and forth with relation to the stabilizer 30. The tool and material holding compartments 45 are of large nature and as such may carry a considerable load. The main component of manufacture of the platform frame 35 and its subsequent tool and material holding compartments 45 is envisioned to be fiberglass though other materials such as steel, wood and the like may also be utilized. The tool and material holding compartments 45 have a drain hole (not visible in this FIG.) to allow for the draining of water should the personal mini-hoist 10 be exposed to rain or other damp or wet conditions. The platform frame 35 has a pair of legs 50 extending downward from the bottom to allow the personal mini-hoist 10 to sit upon grade when not in use. The platform frame 35, along with their supporting structure, will be explained in greater detail hereinbelow. Located on either side of the seat 40, but below the surface of the platform frame 35, is a pair of standoff rods 55 (depicted via dashed lines). The standoff rods 55 are normally in their retracted state until the personal mini-hoist 10 is at the elevation where work will occur. When at that elevation, the worker seated in the seat 40 will extend his legs and push the personal mini-hoist 10 away from the vertical work surface 20. At that point the worker will extend each standoff rods 55 by loosening a thumbscrew 60 and extending the standoff rods 55 down a retraction slots 65 located on the bottom surface of the platform frame 35, adjacent to the outside surface of the legs 50. When the desired distance is reached, the worker would simply re-tighten the thumbscrews 60 and allow the personal mini-hoist 10 to rest against the vertical work surface 20 as supported by the two standoff rods 55. Located at the end of each standoff rod 55 is a suction cup assembly 70. The purpose of the suction cup assembly 70 is twofold. First the suction cup assembly 70 prevents damage to the surface of the vertical work surface 20 and secondly, the suction cup assembly 70 provides a holding means to the vertical work surface 20 when pressure is placed against it, such as when drilling. If the suction cup assembly 70 were not present, the worker would simply push away from the surface, rather than performing work on the surface. In such instances where the holding power of the suction cup assembly 70 is not enough or where a greater safety factor is desired, a series of four eye bolts 75 is provided to tie-off the personal mini-hoist 10 to the vertical work surface 20. Additional safety features can be found in a padded chest protector 80 on which the worker would lean on when performing work operations. Securely fastened to the padded chest protector 80 is a seat belt 85, which the worker would use to fasten him or herself onto the personal mini-hoist 10. The seat belt 85 would prevent the worker from leaning too far to the one side or the other of the personal mini-hoist 10 and would thus protect against accidental falls. Located on the rear of the padded chest protector 80, facing the vertical work surface 20 is a control station 90 and an electrical outlet box 95 as shown. The control station 90 provides for the control of the motor and allows for the lifting and the lowering of the personal mini-hoist 10. The control station 90 is a three-position switch, UP, OFF and DOWN, with a spring return to the OFF position. This feature allows for additional safety, should the worker become incapacitated and unable to operate the personal mini-hoist 10 properly. The electrical outlet box 95 provides a source of electrical power in the shape of a normal duplex receptacle of NEMA configuration 5-15R or 5-20R such as would be found in normal residential electrical system. The electrical outlet box 95 may be used for drills, saws, test equipment or other tools which require a source of electrical power. The electrical outlet box 95 also saves the worker from having to run a separate extension cord to power any tools that would be used on the personal mini-hoist 10.

Figure 2:
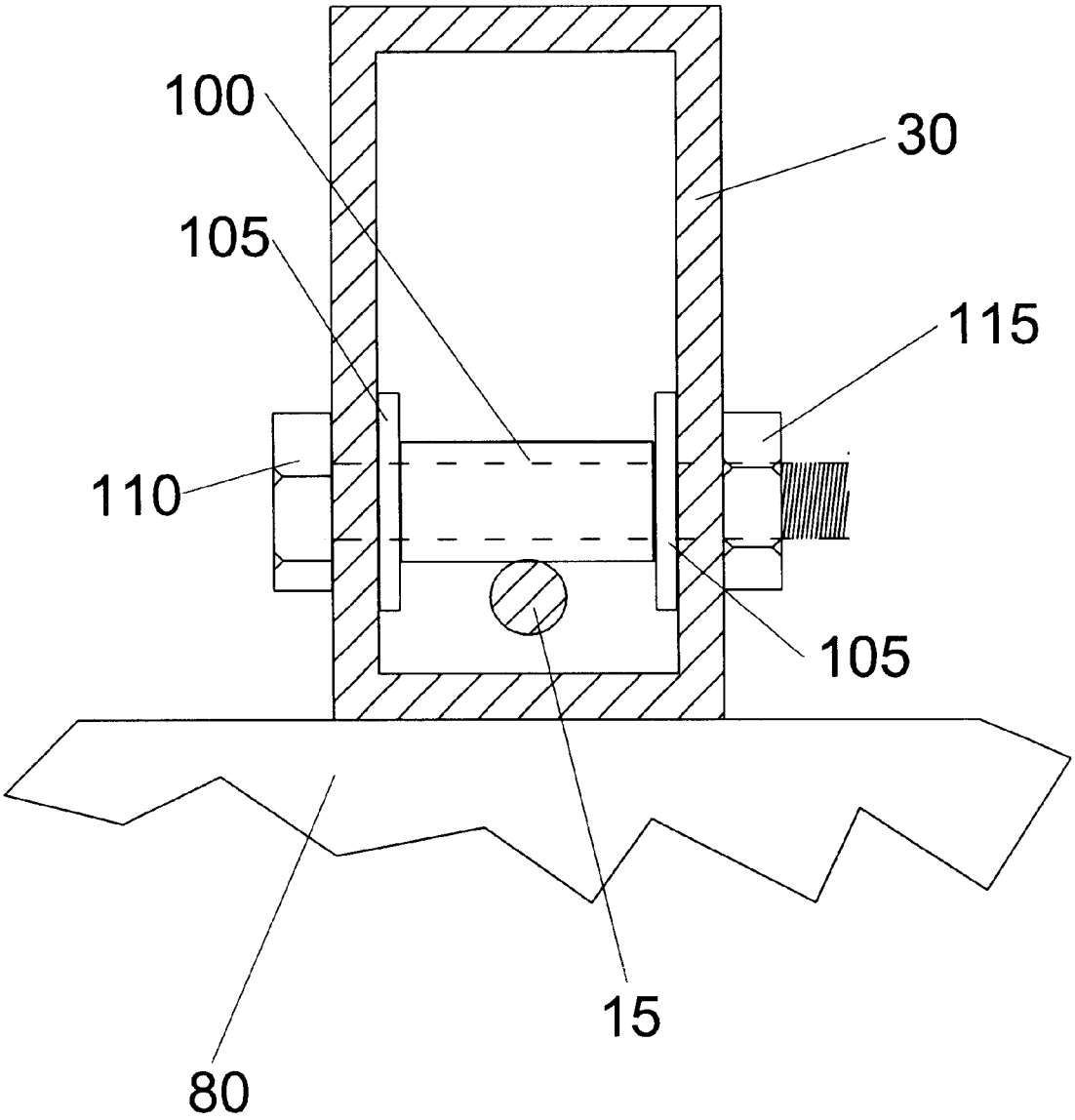
FIG. 2 is a partial cross sectional view as seen along a line II—II in FIG.1.

Referring next to FIG. 2, a partial cross sectional view as seen along a line II—II in FIG. 1 is disclosed. The support cable 15 is shown exiting the stabilizer 30 near its upper portion as shown in FIG. 1. The padded chest protector 80 is shown via a partial view in a broken surface line. The support cable 15 rests against a cable bearing wheel 100 and is guided by two washers 105. The cable bearing wheel 100 and the washers 105 are secured by a first bolt 110, which runs through both surfaces of the stabilizer 30, as well as the washers 105 and the cable bearing wheel 100. The first bolt 110 is secured on its opposing end by a nut 115 as shown. The purpose of the configuration depicted is to prevent the support cable 15 from contacting the stabilizer 30 and thus preventing possible damage to the support cable 15. This possible contact would not only occur when the personal mini-hoist 10 (not shown in this FIG.) is traveling in an up or down path but also when the personal mini-hoist 10 (not shown in this FIG.) is stationary and movement may occur side to side.

Figure 3:
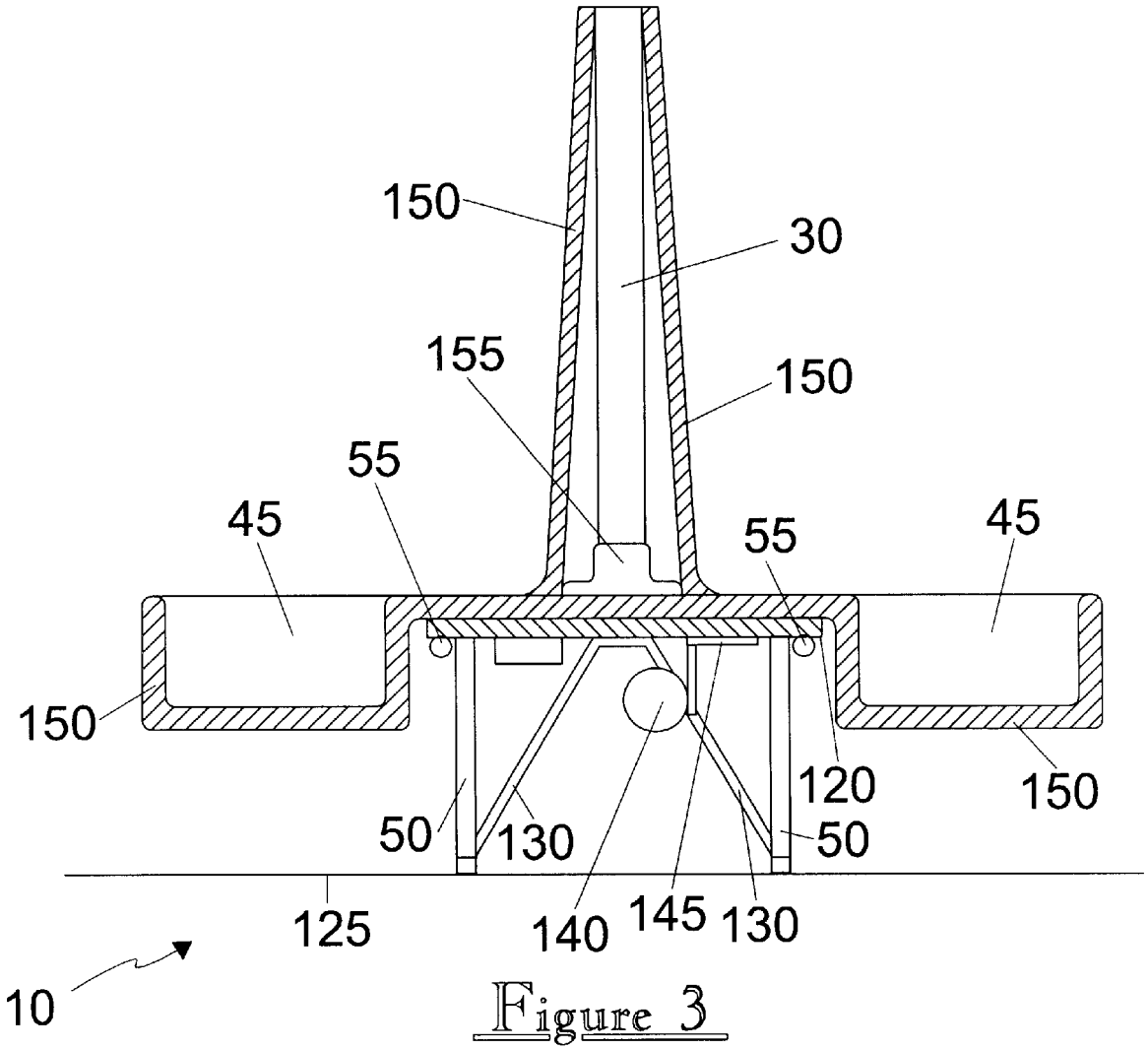
FIG. 3 is a partial cross sectional view as seen along a line III—III in FIG.1.

Referring now to FIG. 3, a partial cross sectional view as seen along a line III—III in FIG. 1 is depicted. A base surface 120, such as plywood, forms the main component upon which all other components of the personal mini-hoist 10 are directly or indirectly fastened to. The legs 50 are fastened to the base surface 120 and extend downward. They are shown here in contact with a flat horizontal surface 125, such as a floor or grade. The legs 50 are supported in their horizontal axis by a leg brace 130. The leg brace 130 is connected to each leg 50 near its lowest point and connected to the base surface 120 near the middle as shown. Also located on the underside of the base surface 120 is the pair of standoff rods 55. Also, located on the bottom of the base surface 120 is an electrical supply box 135, an electrical lift motor with integral cable reel 140 and an electrical lift motor mounting bracket 145, all of which will be described in greater detail hereinbelow. The pair of tool and material holding compartments 45 as well as the upper surface of the base surface 120 is formed from a fiberglass structure 150 as aforementioned described. The fiberglass structure 150 also encases the stabilizer 30 as shown to provide an overall protective surface to the personal mini-hoist 10 that is aesthetically pleasing to the eye. The fiberglass structure 150 located surrounding the stabilizer 30 does not lend any structural significance to the personal mini-hoist 10. The stabilizer 30 is firmly fastened to the base surface 120 by means of a connection bracket 155. The connection bracket 155 is envisioned to be manufactured from a physically strong material such as angle iron. The connection bracket 155 in turn is then fastened to the base surface 120 by means such as bolts that pass through both the surface covering and structural materials thereof.

Figure 4:
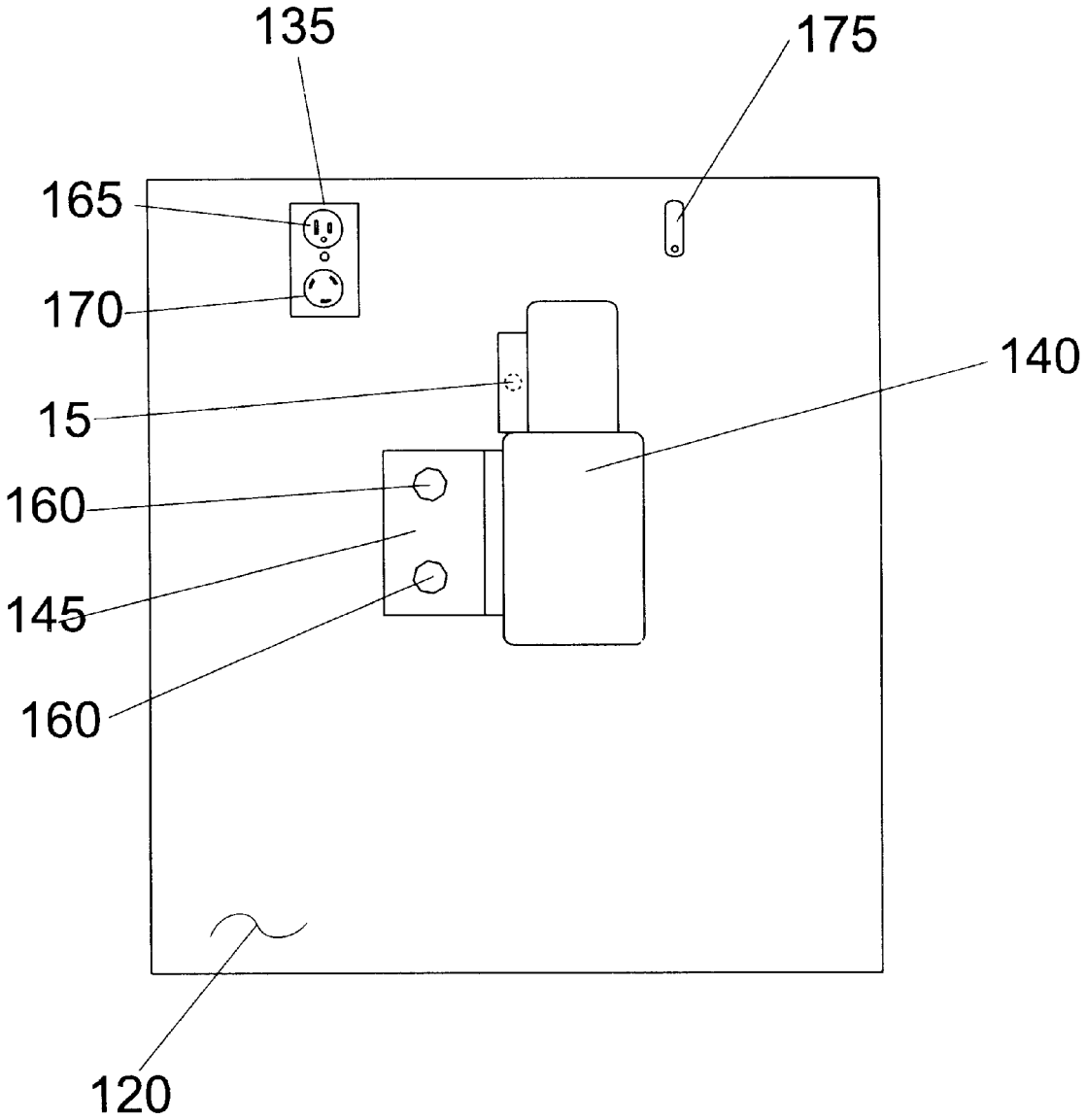
FIG. 4 is a bottom view of the plywood support surface as used with the personal mini-hoist.

Referring next to FIG. 4, a bottom view of the personal mini-hoist 10 (not fully shown in this FIG.) depicting the base surface 120 is shown. The main purpose of the base surface 120 is to provide a firm mounting structure for the electrical lift motor with integral cable reel 140 which generates the main lifting force for the personal mini-hoist 10 (not fully shown in this FIG.) and its passenger and cargo. The support cable 15 (shown via hidden lines) exiting the electrical lift motor with integral cable reel 140 is located exactly in the center of the base surface 120 with reference to its horizontal axis as shown. The factors regarding this placement allow for a balanced platform and increased stability as the support cable 15 passes upward through the base surface 120 and out through the stabilizer 30 (as shown in FIG. 1). The electrical lift motor with integral cable reel 140 is securely held to the base surface 120 via the electrical lift motor mounting bracket 145. The electrical lift motor mounting bracket 145 is held in physical contact with the base surface 120 via a pair of second bolts 160. The electrical supply box 135 possesses two connection points for a source of electrical power for the personal mini-hoist 10 (not fully shown in this FIG.) A normal configuration receptacle 165 consisting of a NEMA 5-15R or a NEMA 5-20R, as would be found in a conventional residence is positioned as one connection point. A twist-lock configuration receptacle 170 such a NEMA L5-15R or a L5-20R is positioned as the alternate connection point. It is envisioned that the twist-lock configuration receptacle 170 would be used as the primary connection means due to its greater security with holding a cord. The normal configuration receptacle 165 would be used with a conventional extension cord when means to use the twist-lock configuration receptacle 170 is not present. Whatever connection means is utilized, a strain relief clamp 175 is provided to hold the electrical power cord (not shown in this FIG.). The strain relief clamp 175 provides a means to ensure that the electrical power cord (not shown in this FIG.) is not accidentally dislodged and to prevent damage to the individual conductors inside the electrical power cord (not shown in this FIG.) that could be caused by excessive flexing near the electrical supply box 135.

Figure 5:
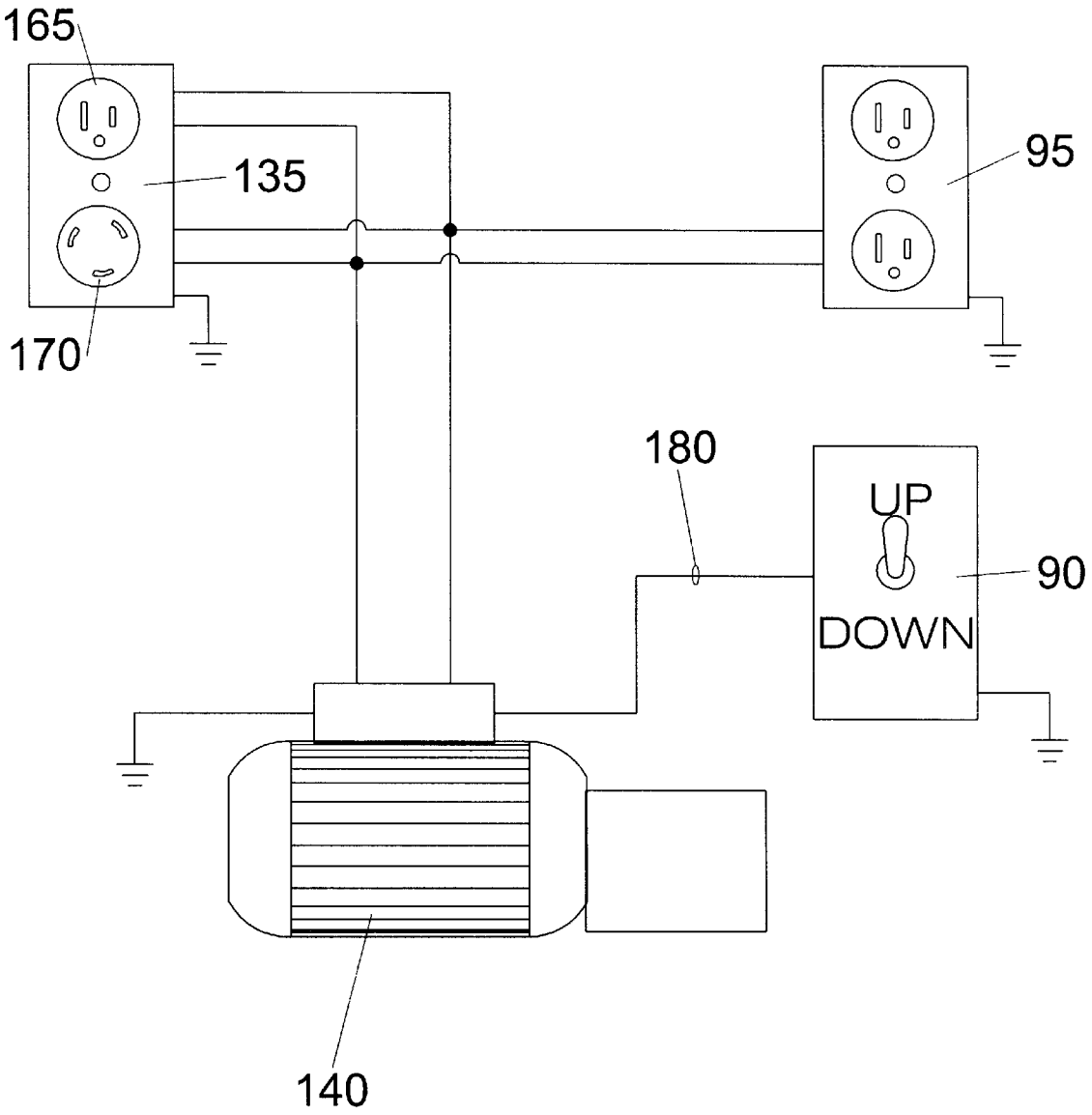
FIG. 5 is a schematic block diagram of the electrical circuitry associated with the preferred embodiment of the present invention.

Referring finally to FIG. 5, a schematic diagram of the electrical circuitry associated with the personal mini-hoist 10 is disclosed. The normal configuration receptacle 165 and the twist-lock configuration receptacle 170 enclosed in the electrical supply box 135 are wired in a parallel fashion as shown. The electrical outlet box 95, which provides power for use with hand tools such as drills while the personal mini-hoist 10 is in an elevated state is also wired in a parallel fashion. Power from these parallel connection points is then routed to the electrical lift motor with integral cable reel 140. A control cable 180 then routes control signals from the control station 90 to the electrical lift motor with integral cable reel 140 to provide up and down control functions. An integral grounding function is also provided between the electrical supply box 135, the electrical outlet box 95 and the electrical lift motor with integral cable reel 140 as depicted.

2. Operation of the Preferred Embodiment

In operation, the present invention can be easily utilized by the common user in a simple and effortless manner. To use the present invention with its preferred embodiment can best be described in conjunction with the perspective view of FIG. 1, the cross sectional views of FIG. 2 and FIG. 3, the bottom view of FIG. 4 and the schematic diagram of FIG. 5.

To use the present invention, the user would first hook up the electrical supply cord to either the normal configuration receptacle 165 or the twist-lock configuration receptacle 170 of the electrical supply box 135, depending on what type of electrical power supply cord is present. Next, the cord would be secured via the strain relief clamp 175 to prevent accidental dislodgement. An appropriate amount of support cable 15 is then removed from the electrical lift motor with integral cable reel 140 by holding the control station 90 in the DOWN position. The support cable 15 is then secured to an outrigger, wall or other appropriate support means and safety lanyards are attached to the eye bolts 75. At this point the user is ready to ascend in the personal mini-hoist 10.

The user would then sit on the seat 40, straddle the stabilizer 30 with their legs, and secure themselves via the seat belt 85 mounted to the padded chest protector 80. If the user wishes to do so, he can select the Up position on the control station 90 while straddling the stabilizer 30 in order to raise the seat 40 to a position for securing himself therein. Next, the user would place the control station 90 in the UP position and walk up the wall or other vertical surface as the personal mini-hoist 10 ascended. When the personal mini-hoist 10 is at the desired elevation, the user would release the control station 90 where it would spring back to the OFF position. The user is now able to extend the standoff rods 55 and lock them into place using the thumbscrew 60. The suction cup assembly 70 located at the end of the standoff rods 55 would provide some degree of protection for the surface of the vertical work surface 20 as well as provide an attachment point to the vertical work surface 20 should the user apply pressure to the vertical work surface 20 such as when using a drill. If additional protection or attachment means are required, the user would tie-off the personal mini-hoist 10 to the vertical work surface 20 by using the eye bolts 75. At this point the work activity planned for the elevated location may proceed.

The work planned for the elevated location may utilize tools and materials carried in the tool and material holding compartments 45. Additionally, the electrical outlet box 95 will provide electrical power for any electrical hand tools such as drills or saws that will be used at the elevated location. When the work activity is completed, the user may move the personal mini-hoist 10 to another elevation to continue work as aforementioned described or descend to ground or grade location.

To descend, the user would disconnect any tie-offs connected to the eye bolts 75 and retract the standoff rods 55. Next, the user would place the control station 90 in the down position and walk down the vertical work surface 20 with the personal mini-hoist 10. As the user approaches the ground, the operator can stand-up easily, allowing the personal mini-hoist 10 to travel the remaining distance to the ground. The legs 50 of the personal mini-hoist 10 will rest on grade or other flat horizontal surface 125 when the personal mini-hoist 10 is completely descended. The user may then unfasten the seat belt 85 and then dismount the personal mini-hoist 10.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. A hoist for use by a single person to scale vertically along the sides of buildings and other vertical structures, said hoist comprising:

a support structure, generally rectangular shape having a pair of longer edges and a pair of shorter edges and having a front edge opposite a rear edge along the longer edges thereof, oriented horizontally and having at least two generally rectangular storage cavities recessed therein and located along the two shorter edges;

at least two vertical support members having a generally rectangular shape and attached to a bottom of said support structure near a central portion thereof, said vertical support members lying along said shorter edges of said support structure and oriented perpendicular thereto, said vertical support members being aligned parallel with one another;

a stabilizer column consisting of a linearly elongated tube, with a generally rectangular cross-section, having a cable end opposite a frame end and attached to a mid-section of said front edge at said frame end and extending vertically from said support structure, said stabilizer column having a support cable guide means located in an interior portion of said stabilizer column at said cable end;

a seat attached to said support structure facing said stabilizer column, a backrest of said seat lying along said rear edge and located about a midpoint thereof;

a padded chest protector attached to said stabilizing column facing said seat, said padded chest protector having a safety belt protruding therefrom;

a drive means securably attached to said support structure, said drive means consisting of a reel attached to a motor means by a gear reducing means in a driving relationship;

a control module attached to said stabilizing column and including a switching means for controlling the operation of said drive means;

a standoff means for resting said personal mini-hoist against the surface of the vertical structure being ascended upon, said standoff means adjustably telescoping from said front edge and including a locking nut, allowing for a variable distance between said vertical structure and said personal mini-hoist; and at least one tie-off eyelet secured to and protruding from the surface of said support structure allowing said personal mini-hoist to be secured to and drawn said vertical structure.

2. The hoist of claim 1 wherein said support structure further comprises a two-piece construction consisting of a frame structure with a molded overlay, said molded overlay contoured and forming said storage cavities and providing a support means for said seat, said frame structure incorporating a mounting means for said drive means.

3. The hoist of claim 1 wherein said vertical support members are sized such that, when said hoist is in its resting position on the ground, said seat is adapted to be elevated to a height no less than one foot and no greater than three feet above the ground.

4. The hoist of claim 1 wherein said reel of said drive means is attached to a support cable, said support cable extending from said reel through said stabilizer column and said cable guide means, said support cable having an attachment means attached to a free end of said cable, allowing said support cable to be attached to said vertical structure.

5. The hoist of claim 1 wherein said seat is positioned opposite said stabilizer column thereby allowing a user's legs straddle said stabilizer column when seated in said seat with said user's torso resting against said chest protector, secured by said safety belt, and allowing said user to gain easy access to said control module.

6. The hoist of claim 1, wherein said drive means is configured in a fail-safe manner such that upon loss of power, said reel is locked in position preventing said personal mini-hoist from rapid descent.

7. The hoist of claim 1 wherein said frame structure is constructed of a material selected from the group comprising iron, steel and aluminum.

8. The hoist of claim 1 wherein said molded overlay is constructed of a material selected from the group comprising wood, plastic and fiberglass.

9. The hoist of claim 1 wherein said vertical support members are constructed of a material selected from the group comprising wood, iron, steel, aluminum, plastic and fiberglass.

10. The hoist of claim 1 wherein said stabilizer column is constructed of a material selected from the group comprising iron, steel and aluminum.

* * * * *